US006291755B1

(12) United States Patent
Hine et al.

(10) Patent No.: US 6,291,755 B1
(45) **Date of Patent: *Sep. 18, 2001**

(54) TUNER FOR STRINGED MUSICAL INSTRUMENTS

(75) Inventors: Arthur H. Hine, 5892-188th Street, Surrey, British Columbia (CA), V3S 7M1; Timothy Collings, White Rock (CA); Carl Burdett, Gibsons (CA); Brian Richardson, Richmond (CA)

(73) Assignee: Arthur H. Hine, Surrey (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/258,906

(22) Filed: Mar. 1, 1999

(Under 37 CFR 1.47)

Related U.S. Application Data

(63) Continuation-in-part of application No. 08/821,788, filed on Mar. 21, 1997, now Pat. No. 5,877,444.

(51) Int. Cl.[7] ..... G10G 7/02

(52) U.S. Cl. ..... 84/454; 84/455; 84/477 R; 84/DIG. 18

(58) Field of Search ..... 84/453–455, 477 R, 84/DIG. 6, DIG. 18

(56) References Cited

U.S. PATENT DOCUMENTS

| | | | |
|---|---|---|---|
| 3,901,120 | 8/1975 | Youngquist . | |
| 4,312,044 | 1/1982 | Baba . | |
| 4,318,327 | 3/1982 | Toups . | |
| 4,434,697 | 3/1984 | Roses . | |
| 5,070,754 | 12/1991 | Adamson . | |
| 5,323,680 | 6/1994 | Miller et al. . | |
| 5,388,496 | 2/1995 | Miller et al. . | |
| 5,408,914 | 4/1995 | Breitweiser, Jr. et al. . | |
| 5,455,381 | 10/1995 | Juszkiewicz et al. . | |
| 5,877,444 * | 3/1999 | Hine et al. | 84/454 |

FOREIGN PATENT DOCUMENTS

WO 95/20213 7/1995 (WO) .

* cited by examiner

*Primary Examiner*—Marlon T. Fletcher
(74) *Attorney, Agent, or Firm*—Hall, Priddy, Myers & Vande Sande

(57) ABSTRACT

A tuner for stringed musical instruments which have a pickup for converting sound vibrations of the strings to electrical signals and a body being either hollow or solid with a front and back surface and a side surface extending between the front and back surface. The tuner has a tuner circuit attachable to an interior of the sound box with an input couplable to an output of the pickup and a digital display which displays a reference note closest to the note being played, a graphically intuitive indication of whether the note being played is above, equal to or below the reference note and a qualitative measure of the amount of deviation from the reference note. The tuner circuit automatically determines a closest note to the note being played and displays alphabetically the closest note.

12 Claims, 5 Drawing Sheets

TUNER FOR STRINGED MUSICAL INSTRUMENTS

RELATED APPLICATION

This application is a continuation-in-part of U.S. patent application Ser. No. 08/821,788, filed Mar. 21, 1997 U.S. Pat. No. 5,877,444.

FIELD

The present invention relates to a digital electronic tuner for stringed musical instruments, particularly designed to be implanted into the sound box of the musical instrument with a digital display positionable to face a user.

BACKGROUND

Electronic tuners for stringed musical instruments use some kind of pickup head to sense the sound vibrations corresponding to the note being played and convert that vibration to an electrical signal. Some tuners use microphones to pick up the tone from air-transmitted sound but such detection is susceptible to error or difficulty in tuning due to ambient noise also picked up by the microphone. The operation of such circuits involves first amplifying and filtering the signal, and then detecting it in a microprocessor to determine the fundamental frequency of the tone being detected utilizing a suitable tuning algorithm. In some circuits this frequency is compared with the true fundamental frequencies of the notes which are stored in processor memory. The frequency of the closest note to the detected frequency of the tone being detected is determined after which various outputs may be provided. Some outputs use a series of flashing lights in the form of light emitting diodes to indicate the closest note. U.S. Pat. No. 5,388,496 issued to Miller et al. discloses an additional output which indicates whether the frequency of the detected tone is above or below the frequency of the closest note. Other kinds of displays such as a null meter, an oscilloscope screen, or coloured lights have been used. U.S. Pat. Nos. 4,312,044 issued to Baba and 4,434,697 issued to Roses discloses use of a multi-digit segment display and an alphanumeric display, respectively.

The location of the electronic and display of known guitar tuners ranges from units which are contained in separate boxes as in U.S. Pat. No. 3,901,120 issued to Youngquist to a display in the form of a series of flashing lights on the side of the guitar finger board as in Miller et al., supra. In Miller et al. the light display is connected by a cable to a casing mounted within the sound box of a guitar. For such an arrangement as in Miller, it would be necessary for a user to memorize which lights correspond to which notes as well as which colours indicate an out-of-tune tone being higher than the frequency of the note being played and which colours indicate an out-of-tune tone being lower than the frequency being played. It would also be necessary in Miller, supra., to connect the external cable from the casing within the sound box to the light display when it is desired to use the tuner.

Accordingly, it is an object of the invention to provide an improved tuner for a stringed musical instrument. It is a further object of the invention to provide a tuner for stringed musical instruments having an improved display. It is yet a further object to provide a tuner for stringed musical instruments implanted into the box and positionable so that it faces a user during tuning.

SUMMARY OF THE INVENTION

According to the invention there is provided a tuner for stringed musical instruments which has a transducer for converting sound vibrations of the strings to electrical signals and a body, either hollow or solid, with a front and back surface and a side surface extending between the front and back surface. The tuner has a tuner circuit mountable in an interior of said body, with an input of the tuner circuit having an input couplable to an output of said transducer. An output of the tuner circuit is connected to a digital display positioned or positionable so that it is visible to a player when the instrument is in a playing position. A first portion of the digital display is operative to automatically represent alphabetically, without reference to a corresponding mark or position, a reference note closest in frequency to a measured tone for all notes capable of being played on said stringed musical instrument. A second portion of the digital display is operative to represent a graphically intuitive indication of whether the measured tone has the same frequency as the reference note, whether the frequency of the measured tone is one of above and below the reference note, and a relative frequency difference between said measured tone and the reference note.

Preferably, the digital display is a multi-segment display and the graphically intuitive indication includes an top segment in the top half of the second portion of the multi-segment display, which top segment has an arrow pointing towards a top of the display and flashes at a rate proportional to a difference between the measured tone and the reference note when the measured tone is one of lower and -higher in frequency than the reference note and a lower segment in the bottom half of the second portion of the multi-segment display having an arrow pointing to a bottom portion of the digital display. The bottom segment flashes at a rate proportional to the difference between the measured tone and the reference note when the measured tone is another of lower and higher in frequency than the reference note. A median segment is located in the middle of the second portion of the multi-segment display, and is perpendicularly oriented relative to the top and bottom segments and lights when the measured tone is equal in frequency to the reference note.

The digital display may be mounted within, and substantially flush to, the side surface on a side closest to a player, the digital display facing the player when the instrument is in a playing position.

The tuner circuit may include a filter and AC decoupler operative to filter signals from the transducer to produce a filtered signal. An inverter and follower circuit may be operative to invert the filtered signal. A one shot circuit may be coupled to an output of the inverter and follower circuit and be triggerable in response to a second half of said filtered signal and be operative to produce a square wave output in response to being triggered. A processor may be coupled to the square wave output signal. The processor may be operative to detect a fundamental frequency of the square wave signal and compare it to reference frequency values corresponding to notes of a musical scale, determine a reference note having a frequency closest to the fundamental frequency of the square wave signal, digitally determine a relative difference between the fundamental frequency of the square wave signal and the reference note and output digital output signals to operate the digital display, including a first signal operative to carry information to alpha-numerically display the reference note and a second signal operative to carry information to graphically display the relative difference between the fundamental frequency of the square wave signal and the reference note.

The fundamental frequency of the square wave signal is determined by measuring the period of each of the square wave signal and then averaging the periods so determined to provide an average period. This average period is then used in examining a look up table in the processor non-volatile memory to select a frequency value therein corresponding to a frequency of a closest note to the note being played for display on the digital display.

The audio output may be coupled to an output of the record and playback apparatus and be operative to provide an audio output for the tuner circuit.

The audio output may include an amplifier coupled to an output of the digital record and playback apparatus, and a jack coupled to an external headphone.

A controls signal circuit may be coupled to the processor, a memory may be coupled to the tuner circuit output and be operative to store notes being played by a stringed instrument and detected by the tuner circuit, a single/timed input switch may be coupled to the controls signal circuit and be operative, in one position, to cause recorded notes stored in the memory to be displayed on the digital display one at a time in sequence with the order in which they were recorded and, in a timed position, to cause the entire contents of the memory to be displayed in the sequence in which they were recorded using a timebase in which they were recorded.

Advantageously, a top segment flashes when the tone has a frequency above that of the note, a bottom segment flashes when the tone has a frequency below that of the note and a median segment flashes when the tone has the same frequency as the note. The rate of flashing of the top and bottom segments is proportional to the difference in frequency of the tone and the note. The median segment is perpendicular to both the top and bottom segments.

Alternatively, the digital display may be pivotally mounted on a front surface of the instrument and springbiased so as to be visible to a user when the instrument is in a playing position, with a catch to hold said digital display substantially along the front surface when not in use and releasable upon pressure being applied to said digital display.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
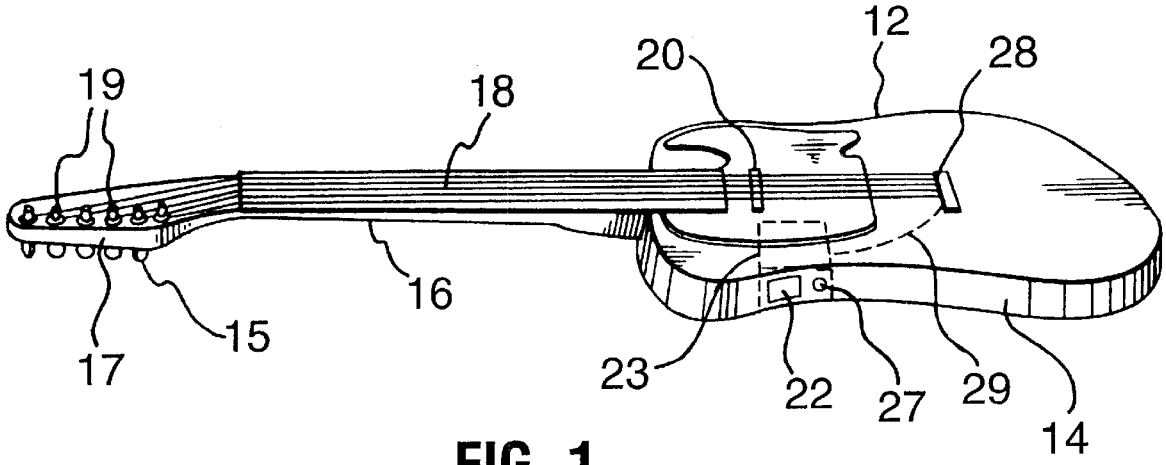
FIG. 1 is a perspective view of a guitar showing the tuner display on the side of the body.

Referring to FIG. 1 there is shown a conventional electric guitar 12 consisting of a body 14 having a pickup 20, a neck 16, and a head stock 17. Body 14 can be either hollow as in a conventional guitar or solid as in an electric guitar. Head stock 17 has six tuning heads 19 around which the ends of six guitar strings 18 are wound. The tuning heads 19 are adjusted by lugs 15. The strings pass over a pickup 20 containing a transducer 30 (see FIG. 3) and terminate on the sound box 14 with bridge pins 28. A digital display 22 is mounted in the side of the body 14 in a location where a player can readily view it. Shown in dotted lines is the tuner 23 which contains a tuner battery 32 to operate the tuner electronics shown in FIG. 3. The tuner 23 is connected electrically to an output of the transducer 30 by line 29. Button 27 is the start button which activates the tuner 23.

Figure 2:
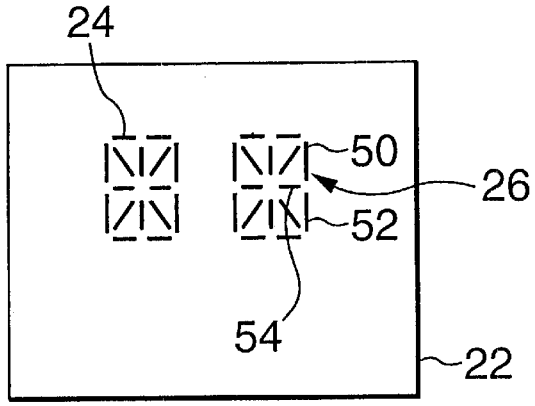
FIG. 2 is a front elevation view of the digital display.

Referring to FIG. 2 the digital display consists of one dot matrix display unit or it could also consist of two 14 segment display elements 24 and 26. Alternatively, the display may consist of a single dot matrix display unit. Digital display 24 displays alphabetically the letter of the note which is closest to the fundamental frequency of the note that is being detected. For example, notes that are displayed by the first segment display element 24 are as follows:

$A^b$, A, $B^b$, B, C, $D^b$, $E^b$, E, F, $G^b$, G Digital display 26 displays whether the frequency of the tone being detected is higher or lower than the frequency of the actual note. A tone of a frequency higher than that of the note is displayed as a flashing bottom segment 52 with an arrow pointing towards the bottom of the display to tell a user to lower the frequency while that of a frequency lower than that of the note is displayed as a flashing top segment 50 with an arrow pointing towards the top of the display to tell a user to raise the frequency. The rate of flashing is proportional to the difference in frequency of the tone and the note. Median segment 54 which is perpendicular to segments 50 and 52 flashes when the tone is of the same frequency as that of the note. The flashing top and bottom segments 50 and 52 can also be given arrows to show the direction of desired frequency change necessary to move towards an "in-tune" condition. The top segment 50 could be used to indicate the need to reduce the frequency and the bottom segment 52 to increase the frequency particularly if these segments are given arrows.

Figure 3:
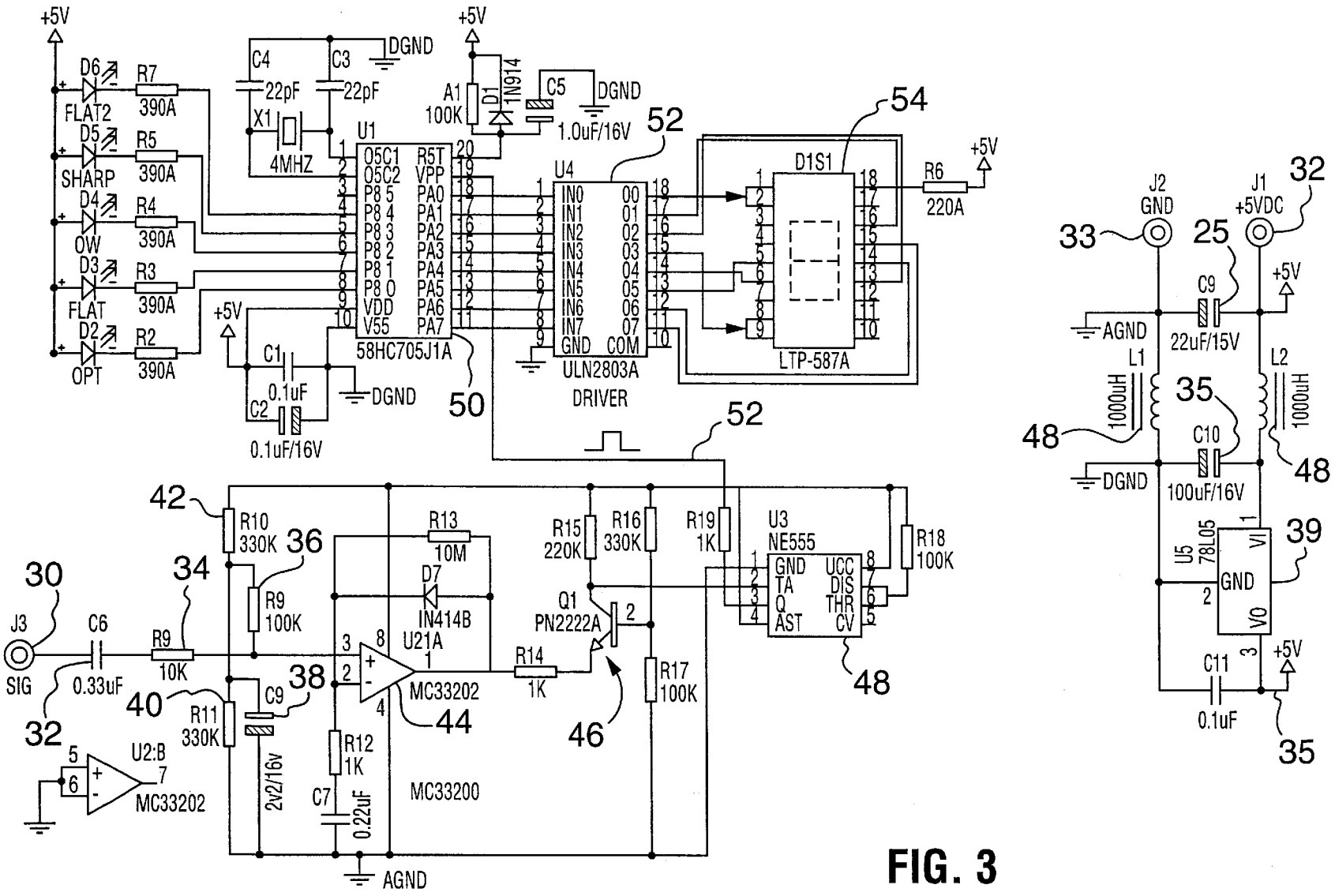
FIG. 3 is a circuit diagram of the electrical circuit of the tuner.

Referring to FIG. 3, the tuner electronics is powered by a 9 volt alkaline battery whose positive output is coupled to terminal 32 and whose negative output is coupled to ground terminal 33. The signal is filtered by a filter consisting of capacitors 25 and 35 and inductors 48 before being applied to a regulator 39. The output of 5 volts is applied to line 35. The regulator 39 provides a regulated +5 volt output for the rest of the electronics.

A pulse train from a pickup transducer and preamplifier (not shown) produces a pulse train at terminal 30 passes through a capacitor 32 and resistor 34 which serve to decouple the DC. Resistors 34, 36, 40, and 42 and capacitor 38 act as voltage dividers with the divided signal being applied to inverter/follower 44. The output of inverter/follower 44 is applied to the emitter of transistor 46, inverted and applied to one shot 48 which generates a clean square wave and applies it to the external interrupt pin of processor 50. The filtering action of capacitor 38 and resistor 34 combined with inversion of the pulse so that a quieter part triggers the one shot 48 avoids the ringing which would otherwise be present and makes the triggering of one shot 48 more uncertain. After receiving three pulses from the one shot 48, on the next pulse, the processor 50 calculates the average period and stores the result in RAM memory. The processor 50 then goes to a look up table of 15 notes plus other data to retrieve the closest note to the frequency detected and to output this through a driver 52 and then to the digital segment display 54.

Figure 4:
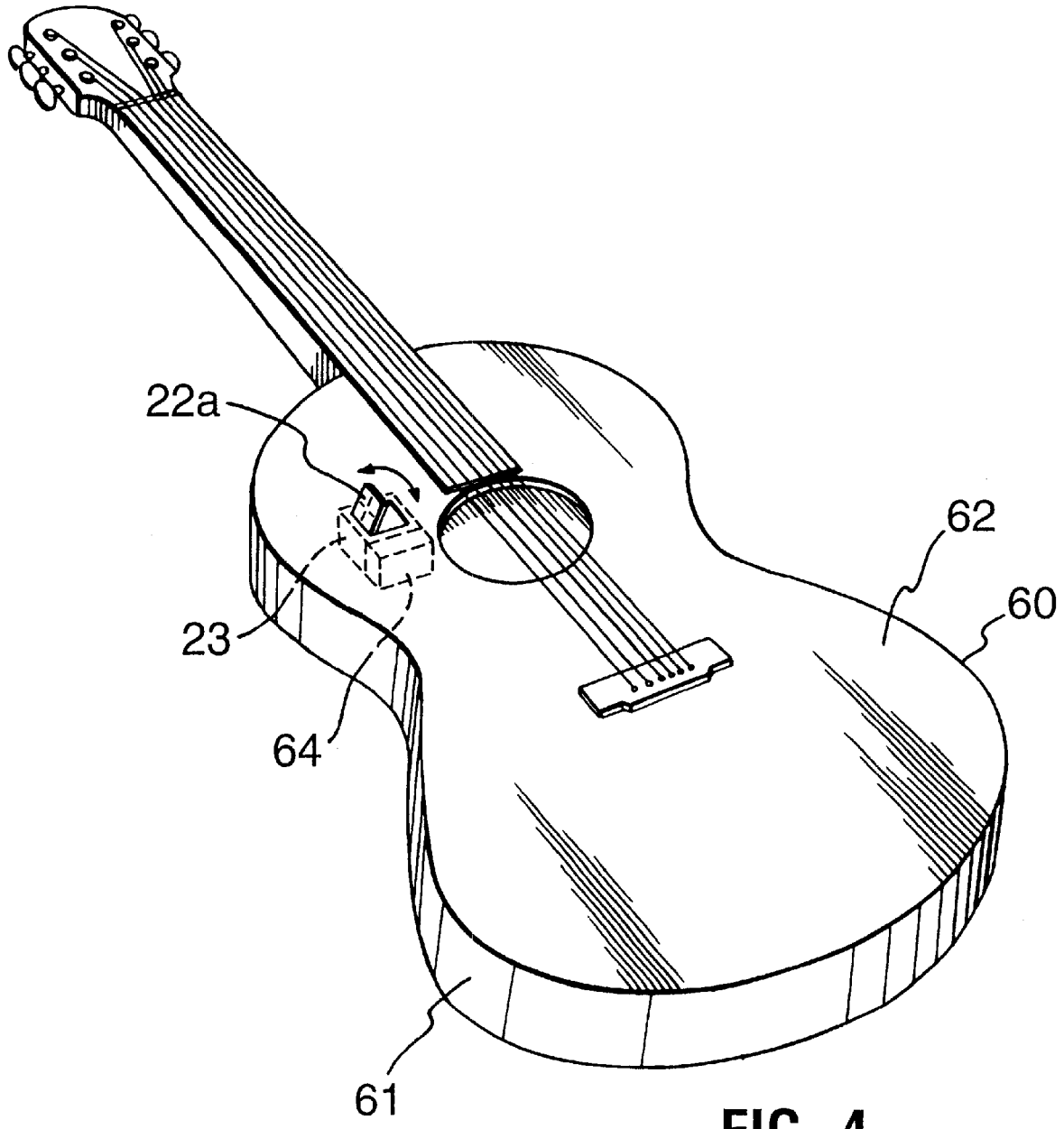
FIG. 4 is a perspective view of a guitar with a hollow body.

Referring to FIG. 4 there is shown a guitar 60 having a hollow body 61 with a top surface 62. In an opening in the front surface 62 there is pivotally mounted a 14 segment display 22*a* which is spring biased towards the position shown which is visible to a user when the guitar is in a playing position. A catch which releases upon pressing down on display 22*a* (not shown) holds the display in a normally flat position in the plane of the front surface 62 Digital display 22*a* is coupled to an output of tuner 23 mounted inside the hollow body 61. A microphone 64 couples to an input of tuner 23. Such a system is applicable to an acoustic guitar with a voice box rather than transducers which are found on electric guitars. Alternatively the pickup could be in the form of piezo electric strip attached to the side surface of the voice box or a diaphragm. The operation Of the tuner in FIG. 4 is otherwise the same as that of FIGS. 1–3.

Figure 5:
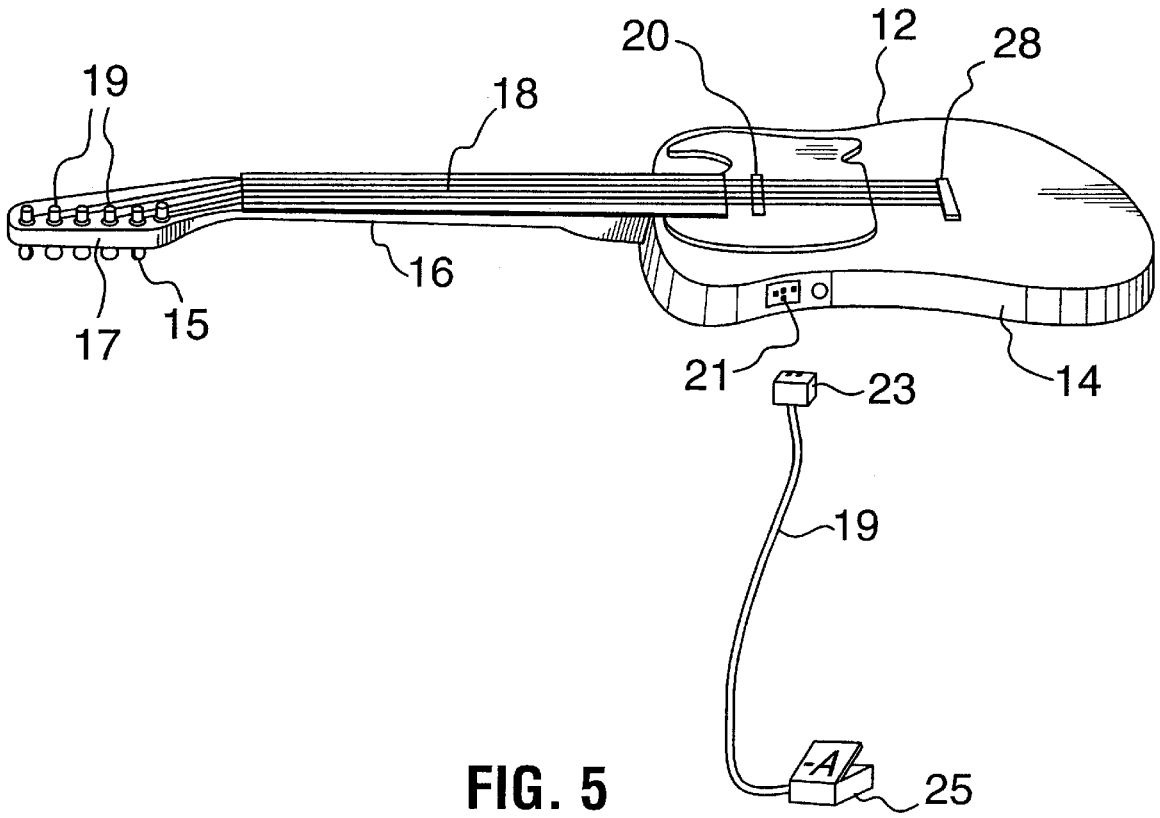
FIG. 5 is a perspective view of a tuner for use on a floor.

As seen in FIG. 5, the tuner can also be used as a floor or desk model 25 remote from the guitar 12 positioned on the floor or on a stand close enough to be seen by a user as shown in FIG. 5. In this case the tuner and digital display 25 is coupled by cable 19 and female connector 23 to a corresponding male pin connector 21. Connector 21 is coupled internally of the box 14 of guitar 12 to an internal guitar transducer or pickup (not shown).

Figure 6:
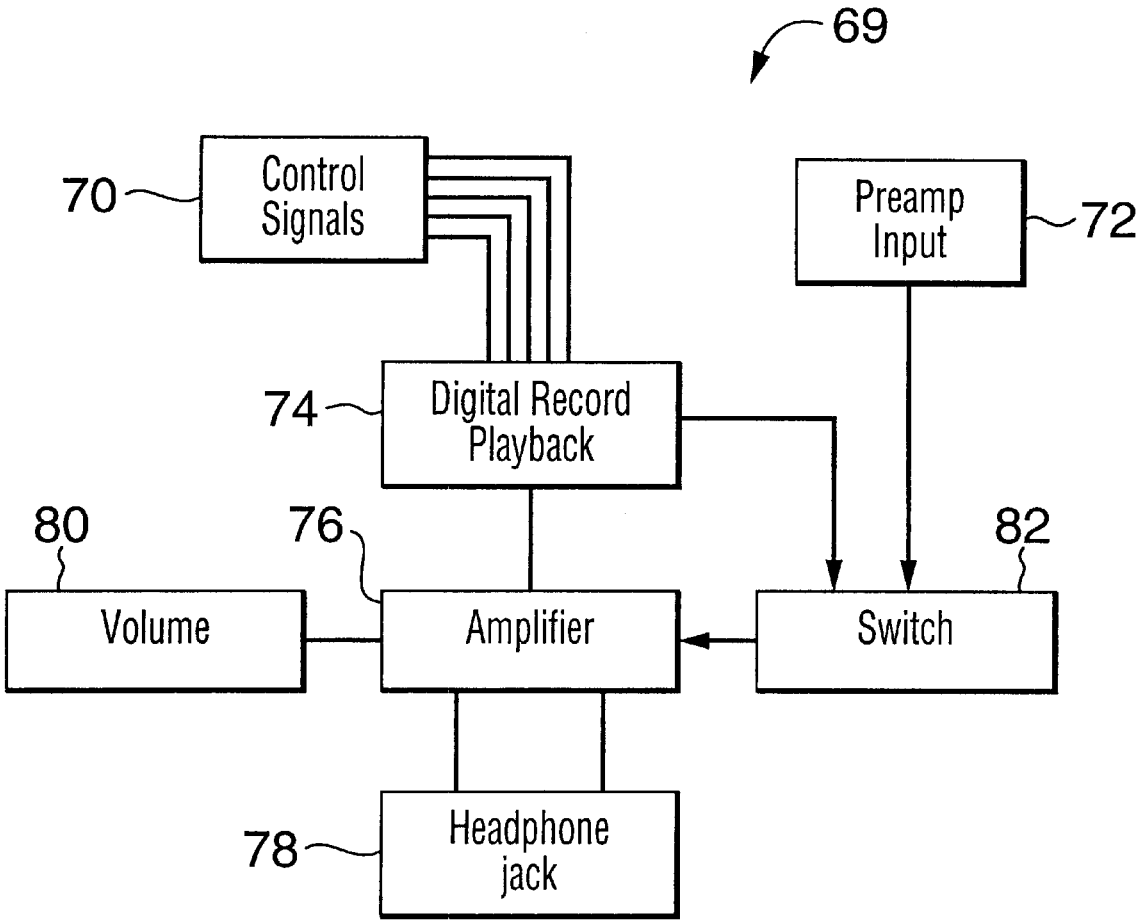
FIG. 6 is block diagram of a universal auditory annunciator adapted for receiving either an output from the tuner output or from the preamplifier of the tuner.

Referring to FIG. 6, there is shown a universal auditory annunciator 69 which is designed to provide an auditory response from the tuner. Analog input signals to the annunciator 69 are provided either from control signals 70 from the processor 50 or from signals from a preamplifier (not shown) that form the input for the transducer signals. A digital recorder and playback unit 74 receives the analog signals from control signals 70, records them and transmits the tuner output directly to amplifier 76. The latter output also goes to switch 82. Preamplifier input 72 also outputs to switch 82 which selects the output from either digital recorder/playback 74 or preamplifier input 72 for transmission to amplifier 76. Amplifier 76 amplifies the tone signals and outputs the amplified signals to a headphone sack 78. The output of amplifier 76 is formed on two different lines. One output line carries the annunciated result of the processor 50, while the other carries either the annunciated result from the tuner or the actual input from the stringed instrument. The volume control 80 adjusts the amplitude of the signal output from the amplifier 76. Digital record/playback 74 also outputs to control signals 70 during its playback mode so that the digital display 54 can display the recorded notes.

Figure 7:
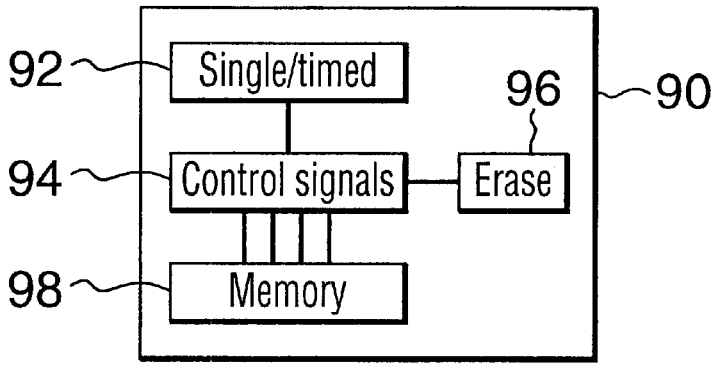
FIG. 7 is a block diagram of a universal memory module.

Referring to FIG. 7 there is shown a universal memory module 90 which includes a single/timed input switch 92 coupled to control signals 94 which correspond to selected output signals from processor 50. The single/timed input switch 92 is coupled to the control signals 94, outputs from which are directed into memory 98. An erase switch 96 is coupled to control signals 94, activation of which causes erasure of the entire contents of memory 98. The single/timed input switch 92 enables a user to step through the recorded notes one at a time. The timed function once enabled, will cause the entire contents of memory to be played back in the sequence in which they were recorded.

The universal memory module 90 allows the ability to record and review (at a later time) all of the notes played on any stringed instrument. Once recording has been complete, the notes may be retrieved in the sequence recorded individually or automatically (using the timebase used for recording). Use of non-volatile memory allows the device to be powered down (turned off) while still retaining the recorded information.

While reference has been made only to guitars, in fact, it is obvious that the tuner would also work for other stringed musical instruments such as a bass guitar, Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A tuner apparatus for stringed musical instruments, which instruments have a body being one of hollow and solid, with a front and back surface and a side surface extending between the front and back surfaces, playing strings mounted on a front surface, a pickup coupled to said strings for converting sound vibrations of said strings to electrical signals, the tuner apparatus comprising:

(a) a tuner circuit having an input couplable to an output of said pickup and said tuner circuit operative to produce a tuner circuit output; and (b) a multi-segment digital display coupled to said tuner circuit output, a first portion of said digital display being operative to automatically represent alphabetically, without reference to a corresponding mark or position, a reference note closest in frequency to a measured tone for all notes capable of being played on said stringed musical instrument, and a second portion of which is operative to represent a graphically intuitive indication of whether said measured tone has the same frequency as said reference note, whether the frequency of said measured tone is one of above and below said reference note, and a relative frequency difference between said measured tone and said reference note, said graphically intutive indicuation including:

(a) a top segment in the top half of said second portion of said multi-segment display, which top segment has an arrow pointing towards a top of said display and flashes at a rate proportional to a difference between said measured tone and said reference note when said measured tone is one of lower and higher in frequency than said reference note; and (b) a bottom segment in the bottom half of said second portion of said multi-segment display having an arrow pointing to an upper portion of said display, which bottom segment flashes at a rate proportional to the difference between said measured tone and said reference note when said measured tone is another of lower and higher in frequency than said reference note.

2. A tuner apparatus according to claim 1, wherein said graphically intuitive indication further includes:

a median segment in the middle of said second portion of said multi-segment display, which median segment is oriented perpendicularly to said top and bottom segment and lights when said measured tone is equal in frequency to said reference note.

3. A tuner apparatus according to claim 1, wherein said digital display is mounted on said guitar on one of a front surface and side surface closest a player.

4. A tuner apparatus according to claim 1, wherein said digital displaying mounted within, and substantially flush to, said side surface on a side closest to a player, said digital display facing the player when said instrument is in a playing position.

5. A tuner apparatus according to claim 1, wherein said tuner circuit includes:

(a) a filter and AC decoupler operative to filter signals from said transducer to produce a filtered signal;

(b) an inverter and follower circuit operative to invert said filtered signal;

(c) a one shot circuit coupled to an output of said inverter and follower circuit triggerable in response to a second half of said filtered signal and operative to produce a square wave output in response to being triggered;

(d) a processor coupled to said square wave output signal, said processor operative to:

(i) detect a fundamental frequency of said square wave signal and compare it to reference frequency values corresponding to notes of a musical scale;

(ii) determine a reference note having a frequency closest to said fundamental frequency of said square wave signal;

(iii) digitally determine a relative difference between said fundamental frequency of said square wave signal and said reference note; and (iv) output digital output signals to operate said digital display, including a first signal operative to carry information to alpha-numerically display said reference note and a second signal operative to carry information to graphically display said relative difference between said fundamental frequency of said square wave signal and said reference note.

6. A tuner apparatus according to claim 5, wherein the fundamental frequency of said square wave signal is determined by measuring the period of each of said square wave signals and then averaging the periods so determined to provide an average period.

7. A tuner apparatus according to claim 6, including storing said average period in processor volatile memory and then examining a look up table in said processor non-volatile memory and selecting a frequency value therein corresponding to a frequency of a closest note to the note being played for digital display on said digital display.

8. A tuner apparatus according to claim 5, including a digital record and playback apparatus coupled to output signals of said processor operative to record said output signals and to play them back for recordal on said digital display.

9. A tuner apparatus according to claim 8, including an audio output coupled to an output of said record and playback apparatus operative to provide an audio output for said tuner circuit.

10. A tuner apparatus according to claim 9, wherein said audio output includes an amplifier coupled to an output of said digital record and playback apparatus, and a jack coupled to an external headphone.

11. A tuner apparatus according to claim 5, including a controls signal circuit coupled to said processor, a memory coupled to said tuner circuit output operative to store notes being played by a stringed instrument and detected by said tuner circuit, a single/timed input switch coupled to said controls signal circuit operative, in one position, to cause recorded notes stored in said memory to be displayed on said digital display one at a time in sequence with the order in which they were recorded and, in a timed position, to cause the entire contents of said memory to be displayed in the sequence in which they were recorded using a timebase in which they were recorded.

12. A tuner apparatus for stringed musical instrument, which instruments have a body being one of hollow and solid, with a front and back surface and a side surface extending between the front and back surface, which tuner apparatus comprises:

(a) a pickup for converting sound vibrations of said strings to electrical signals, which transducer is one of:

(i) a part of said stringed instrument; and (ii) an external device coupled to said stringed instrument;

(b) a tuner circuit mountable in an interior of said body, said tuner circuit having an input couplable to a pickup output and said tuner circuit operative to produce a tuner circuit output; and (c) a digital display pivotally mounted on said front surface of said body and spring biased so as to be facing a player, making said digital display easily readable when said instrument is in a playing position, said digital display further comprising:

(i) a catch to hold said digital display substantially flush to said front surface when not in use; and (ii) a combination power and release mechanism which mechanism is operable, when pressure is applied to said digital display, to release said catch, allowing said digital display to open and face said player, and simultaneously to power said tuner apparatus;

said digital display being coupled to said tuner circuit output, and said digital display including one of a segment display and a dot matrix display, a first portion of which is operative to represent alphabetically, without reference to a corresponding mark or position, a reference note closest in frequency to a measured tone, and a second portion of which is operative to represent a graphically intuitive indication of whether said measured tone has the same frequency as said reference note, whether the frequency of said measured tone is one of above and below said reference note, and a relative frequency difference between said measured tone and said reference note.

* * * * *